US007180251B2

(12) United States Patent
van Eerden

(10) Patent No.: US 7,180,251 B2
(45) Date of Patent: Feb. 20, 2007

(54) ELECTRONIC POWER CIRCUIT FOR GAS DISCHARGE LAMPS

(75) Inventor: Gerrit Hendrik van Eerden, Aalten (NL)

(73) Assignee: N.V. Nederlandsche Apparatenfabriek NEDAP, Groenlo (NL)

( * ) Notice: Subject to any disclaimer, the term of this patent is extended or adjusted under 35 U.S.C. 154(b) by 312 days.

(21) Appl. No.: 10/950,649

(22) Filed: Sep. 28, 2004

(65) Prior Publication Data

US 2005/0057183 A1 Mar. 17, 2005

Related U.S. Application Data

(63) Continuation of application No. PCT/NL03/00239, filed on Mar. 28, 2003.

(30) Foreign Application Priority Data

Mar. 28, 2002 (NL) ..... 1020276

(51) Int. Cl.
*H05B 37/02* (2006.01)

(52) U.S. Cl. ..... 315/291; 315/307

(58) Field of Classification Search ..... 315/291, 315/307, 171, 172, 178, 209 R, 211, 214, 315/DIG. 7
See application file for complete search history.

(56) References Cited

U.S. PATENT DOCUMENTS 3,611,021 A 10/1971 Wallace ..... 315/239
4,060,751 A 11/1977 Anderson ..... 315/209
5,245,253 A * 9/1993 Quazi ..... 315/224
5,289,083 A * 2/1994 Quazi ..... 315/224
5,463,284 A * 10/1995 Mattas ..... 315/240
5,563,473 A 10/1996 Mattas et al. ..... 315/240
5,569,984 A * 10/1996 Holtslag ..... 315/307
5,623,187 A 4/1997 Caldeira et al. ..... 315/307
5,844,380 A 12/1998 Siepkes ..... 315/307
5,914,571 A 6/1999 Beasley ..... 315/244
6,211,620 B1 * 4/2001 Gyoten et al. ..... 315/106
2002/0153849 A1 * 10/2002 Ribarich ..... 315/247

FOREIGN PATENT DOCUMENTS

EP 0477621 A1 4/1992
GB 2279187 A 12/1994
WO WO97/43875 11/1997

* cited by examiner

*Primary Examiner*—David Vu
*Assistant Examiner*—Minh Dieu A
(74) *Attorney, Agent, or Firm*—Jacobson Holman PLLC

(57) ABSTRACT

An input dc-voltage, usually obtained from an AC-mains voltage through a pre-connected rectifier and Power Factor Corrector, is converted by a series connection of two power transistors to an ac-voltage, which, via an LC section is presented to a gas discharge lamp.

For starting the lamp, the power transistors are switched with a frequency which is slightly higher than approximately one-third or one-fifth of the resonance frequency of the LC section.

Circuits have been provided for limiting the output voltage, for limiting the lamp current and for stabilizing the lamp output. Safety circuits switch the power circuit off if the lamp does not ignite or if the lamp exhibits rectifying effect.

64 Claims, 8 Drawing Sheets

ELECTRONIC POWER CIRCUIT FOR GAS DISCHARGE LAMPS

This is a continuation of PCT/NL03/00239 filed Mar. 28, 2003 and published in English.

BACKGROUND OF THE INVENTION

The invention relates to a power circuit for starting and operating a gas discharge lamp with ac-voltage and, in particular, to a power circuit for starting and operating a gas discharge lamp with ac-voltage where the power circuit is provided with:

at least a first and a second lamp output terminal between which, in use, the gas discharge lamp is connected, a dc-voltage input, with at least two input terminals, a series connection of at least two switching elements such as, for instance, power transistors, which is connected between the input terminals of the dc-voltage input, a control circuit arranged for delivering control pulses to the switching elements for bringing those switching elements alternately and without overlap into conduction, at least one lamp coil which is connected on the one side to the junction of the switching elements and is connected on the other side to the first lamp output terminal, at least one resonance capacity, at least comprising one or more capacitors, the resonance capacity being connected, on the one side, to the first lamp output terminal and being connected, on the other side, to one or both input terminals, at least one coupling capacity, at least comprising one or more capacitors, the coupling capacity having a capacity value which is considerably greater than the capacity value of the resonance capacity, the coupling capacity being connected, on the one side, to the second lamp output terminal and being connected, on the other side, to one or both terminals of the dc-voltage input, and a variable frequency oscillator which, in use, delivers a signal to the control circuit with a frequency which is determinative of the control frequency with which the switching elements are brought into conduction, periodically and without overlap.

Known electronic power circuits for gas discharge lamps are typically built up as indicated in FIG. 1. The ac-voltage, originating from an ac-voltage source 1, typically the voltage furnished by the public electricity grid, is rectified by rectifier 4 after high-frequency filtering by filter 3, and then converted by a Power Factor Corrector 5 to a smoothed dc-voltage. Here, Power Factor Corrector 5 ensures that the current supplied by the voltage source 1 to the power circuit meets the requirements applying in respect of harmonic currents for lighting appliances.

The dc-voltage obtained in the manner described is converted by two switching elements such as, for instance, power transistors 6*a* and 6*b*, which are driven by control circuit 7, to an ac-voltage with a much higher frequency than the supply ac-voltage from source 1. The thus formed block-shaped or, when voltage rate limiting capacities 6*c* and 6*d* are present and when power transistors 6*a* and 6*b* conduct in a less than overlapping manner, trapezium-shaped ac-voltage is passed, via an LC-section consisting of self induction 8, further to be called lamp coil 8 and capacity 9, further to be called resonance capacity, to one electrode of the lamp 10 to be supplied. The second electrode of lamp is connected, via a coupling capacitor 11, to one of the dc-voltage outputs of Power Factor Corrector 5.

For starting the lamps, the control frequency for power transistors is selected such that it is in the vicinity of the resonance frequency of the output circuit, formed by lamp coil 8 and resonance capacity 9, so that across this output circuit a sufficiently high voltage is built up to have the connected lamp ignite.

With the customary circuits for power circuits, as described in the introduction, the LC-circuit, consisting of lamp coil 8 and resonance capacity 9, is designed to be relatively low-ohmic with a characteristic impedance $Z_0$=sqrt (L(8)/C(9)), which is in the same order of magnitude as the high-frequency compensating resistance with which a gas discharge lamp in stable, high-frequency operation can be modeled. This leads to a relatively large coil and to large currents through the coil and the power transistors at ignition of the lamps.

Consequently, the load on the transistors in the ignition stage of the lamp is rather high and reliability problems may occur, or very costly power transistors are required, while, also in normal operation, the losses in the lamp coil are rather large, so that the internal temperature of the power circuit becomes high, or relatively expensive constructions are to be used to keep the temperature sufficiently low. This is of interest particularly with regard to the presence of electrolytic capacitors in the power circuit, which, at a high temperature, have a very short life span.

A variant on the power circuits described hereinabove is known from U.S. Pat. No. 5,914,571, wherein for the lamp ignition of the high intensity gas discharge lamp, use is made of a resonant circuit operating on the third harmonic of the control frequency, and, for normal operation, a resonance capacity is included in series with the lamp coil. With this solution the height of the ignition voltage is determined by the damping in the resonance circuit effecting the ignition. The height of the ignition voltage is mostly limited by magnetic saturation phenomena in the lamp coil. Further, the charge on the switching transistor remains quite high, in that, in such circuits, at least in a large part of the lamp ignition phase large 'shoot through' currents occur in the series connection of the power transistors, as a result of the recovery process occurring in the diodes at the moment the power transistors switch on. This is the case because at the moment one of the transistors switches on, the current still runs through the anti-parallel diode of the other transistor. This leads to additional losses in the switching transistors, and, in certain types of transistors also to a reduced reliability. Further, in the circuit according to U.S. Pat. No. 5,914,571, in normal operation when the gas discharge lamp is supplied via the series resonant circuit formed by the lamp coil and the additional resonant capacity (not shown in FIG. 1), the voltage across the lamp coil is relatively high, leading to a relative large coil with relatively much loss, having the above-mentioned drawbacks.

In the existing electronic power circuits, the losses are quite large particularly in the coil connected in series with the lamp, as set forth hereinabove.

Without additional costly measures, this has an adverse effect on the electrolytic capacitor included in the Power Factor Corrector, which capacitor, due to the high temperatures for some uses, has too short a life span so that it is difficult to construct a compact electronic power circuit. The fact is that the internal temperature of the electrolytic capacitor, determined by the internal temperature in the electronic power circuit, enhanced with the temperature increase resulting from the ac-voltage charge of the electrolytic capacitor, is determinative to the life span of this type of capacitor. To this it can be added that the electrolytic capacitor in the known electronic power circuits undergoes a relatively high ac-voltage charge in that ac-voltage from the converter of the Power Factor Corrector as well as from the dc-voltage to ac-voltage converter feeding the lamps, run through this capacitor. This causes additional internal temperature increase of the electrolytic capacitor and a further shortening of the life span of this capacitor.

The result is that the existing electronic power circuits become defective, sometimes after only a few years of operation, in particular in uses when they operate continuously, therefore for 168 hours a week, or almost continuously.

Further, especially with older gas discharge lamps, the risk of the rectifying effect in the gas discharge lamp is present. Under certain circumstances, this rectifying effect may cause the electronic power circuit to become defective.

Further, in most known electronic power circuits, the lamp output depends on the condition of the gas discharge lamp. With high intensity gas discharge lamps, this can change as a result of change in the emission properties of the electrodes, especially caused by the electrodes burning down, so that they become shorter during the life span of the lamp. With low intensity gas discharge lamps, without additional measures, the ambient temperature of the lamp plays a large part in the power consumption of the lamp. When used for illuminating purposes, a constant light output is desirable, while in uses wherein ultraviolet radiation of the gas discharge lamp is used for water purification, by utilizing the bactericidal action of the UV-radiation, a constant amount of emitted UV-radiation is desirable. This latter can be achieved by stabilizing the lamp output. Moreover, it can be desirable to be able to reduce the lamp output to save power or to lengthen the life span of the lamp or the life span of the electronic power circuit. In some uses, stabilizing the lamp current through the gas discharge lamp can be desirable instead of stabilizing the lamp output, for instance in connection with the life span of a special construction of the lamp electrodes.

Further, existing electronic power circuits are often not suitable for igniting gas discharge lamps via long connecting wires, because the wiring capacity of the connecting wires affects the resonant circuit used for the ignition of the lamp such that the ignition voltage required for a reliable ignition is no longer achieved.

Another drawback of the known electronic power circuits is that feeding high intensity gas discharge lamps takes place at a frequency at which acoustic resonances can occur in the lamp, which may shorten the life span of the lamp and lead to troublesome "light twinkling phenomena" in the lamp.

SUMMARY OF THE INVENTION

The first object of the invention is to realize an electronic power circuit for gas discharge lamps, wherein the losses in the lamp coil are small, and wherein, also, the losses in and the charge of the power transistors, transforming the dc-voltage furnished by the Power Factor Corrector or by a different dc-source into ac-voltage, remain low, especially in the lamp ignition stage. In this manner, the reliability can be guaranteed, no expensive transistors need to be used and the internal temperature of the electronic power circuit remains low, also with a compact manner of construction.

The second object of the invention is to realize an electronic power circuit for gas discharge lamps wherein the connected gas discharge lamp can also be reliably ignited when a long connecting wire is included between electronic power circuit and the lamp to be supplied.

The third object of the invention is to realize an electronic power circuit for gas discharge lamps, wherein no defects to the electronic power circuit occur when the gas discharge lamp exhibits the rectifying effect.

The fourth object of the invention is the possibility of stabilizing the power given to the gas discharge lamp or the current delivered to the gas discharge lamp at an adjustable value within wide boundaries independent of aging of the lamps, or of ambient temperature of the lamps.

The fifth object of the invention is to realize an electronic power circuit for gas discharge lamps, wherein no disadvantageous acoustic resonances can occur in a high intensity gas discharge lamp connected to the electronic power circuit.

The sixth object of the invention is to keep the losses in the electrolytic capacitor included in the Power Factor Corrector low, so that a long life span of the electronic power circuit can be guaranteed.

The invention contemplates providing an electronic power circuit which provides a solution which meets at least a number of the drawbacks mentioned and/or realizes at least a number of the objects mentioned.

Accordingly, the electronic power circuit according to the invention is characterized by the feature of claim 1.

Thus, losses in the lamp coil in the ignition stage remain small. In practical tests, the power circuit according to the invention has been found to give good results, for instance in the use of high intensity metal halide and sodium lamps, and also with low intensity gas discharge lamps, in which, in cooled condition of the lamp, the mercury present in the lamp is bonded in amalgam.

The first object is achieved, in particular, by a possible embodiment according to the invention in which the resonance frequency of the resonant circuit, formed by lamp coil 8 and resonance capacity 9 in parallel with the wiring capacity between the lamp to be supplied and power circuit is selected slightly lower than an odd multiple, preferably equal to three, of the control frequency for bringing power transistors 6*a* and 6*b* alternately and without overlap into conduction, generated by control circuit 7 at the starting of the lamp 10. In particular, also during operation with undimmed lamp 10, the control frequency mentioned for alternately bringing transistors 6*a* and 6*b* into conduction, is considerably lower than the resonance frequency mentioned. Further, preferably, the control frequency for bringing the switching transistors alternately and without overlap into conduction is actively regulated (influenced), preferably in a manner to be further indicated in detail in the description, so that the losses remain low and a good reliability of the power circuit is achieved in that the conditions for Zero Voltage Transition are met.

The second object is achieved by a possible embodiment according to the invention in which the frequency regulation of the ignition voltage and the control frequency for bringing power transistors 6*a* and 6*b* alternately and not in an overlapping manner into conduction is dimensioned such that in the ignition stage, the conditions for Zero Voltage Transition are met, also if there is a longer connecting line provided with an earthed protective sheath of, for instance, a length of 10 meters between power circuit and the lamp to be supplied.

The third object is achieved by a possible embodiment according to the invention in which the power circuit is arranged so as to measure the voltage across coupling capacity 11 in FIG. 1 or 11*a* in FIG. 3, and to block the delivery of the control pulses or to switch off the power circuit if this voltage falls outside preset limits.

The fourth object is achieved by a possible embodiment according to the invention in which the power circuit is provided with current measuring means which are included in one of the connecting lines between Power Factor Corrector 5 and the series connection of the transistors 6*a* and 6*b*, and to compare the thus measured current with the desired value of the current, or in which, in case of lamp current stabilization, current measuring means are included in one of the connecting lines to the gas discharge lamp, while, on the basis of the measured difference between desired and real value of the current, the control frequency of power transistors 6*a* and 6*b* is varied in a manner such that the desired value of the current is achieved.

The fifth object is achieved by a possible embodiment according to the invention in which a relatively high operating frequency has been selected for the power circuit, and further the power taken from the dc-voltage supply source has been stabilized. A high operating frequency, for instance higher than 100 kHz minimum frequency, is possible because at startup as well as in operation, Zero Voltage Transition occurs when the power transistors are switched on and off, so that, despite the high operating frequency, the switch losses remain very low.

The sixth object is achieved by a possible embodiment according to the invention in which, in series with at least one of the input dc-voltage terminals, an inductance coil is included, preferably in combination with a damping resistance.

BRIEF DESCRIPTION OF DRAWING

Presently, the invention will be described in further detail with reference to the Figures. In the Figures.

Figure 1:
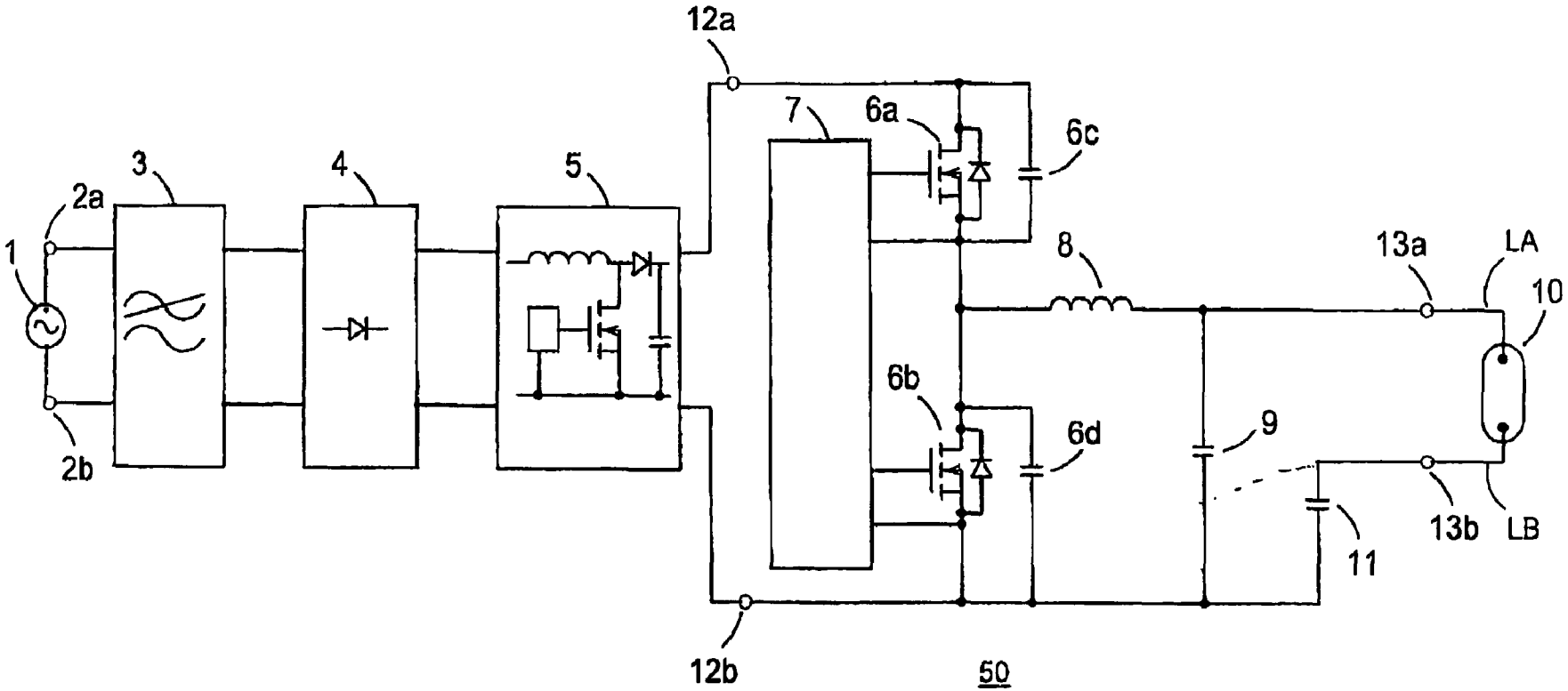
FIG. 1 shows general block diagram of an electronic power circuit of the type to which the invention relates.

The operation of the circuit of FIG. 1 has already been discussed in the introduction. The invention relates to electronic power circuits which supply gas discharge lamps, wherein, in most cases, the peak-to-peak value of the lamp voltage is lower than the dc-voltage at the output of Power Factor Corrector 5, or than the dc-voltage which is presented at the input. A customary voltage when the power circuit is fed by 230 V ac-voltage, is 400 VDC for the output of the Power Factor Corrector and a peak-to-peak value of the lamp voltage of 350 V.

Figure 3:
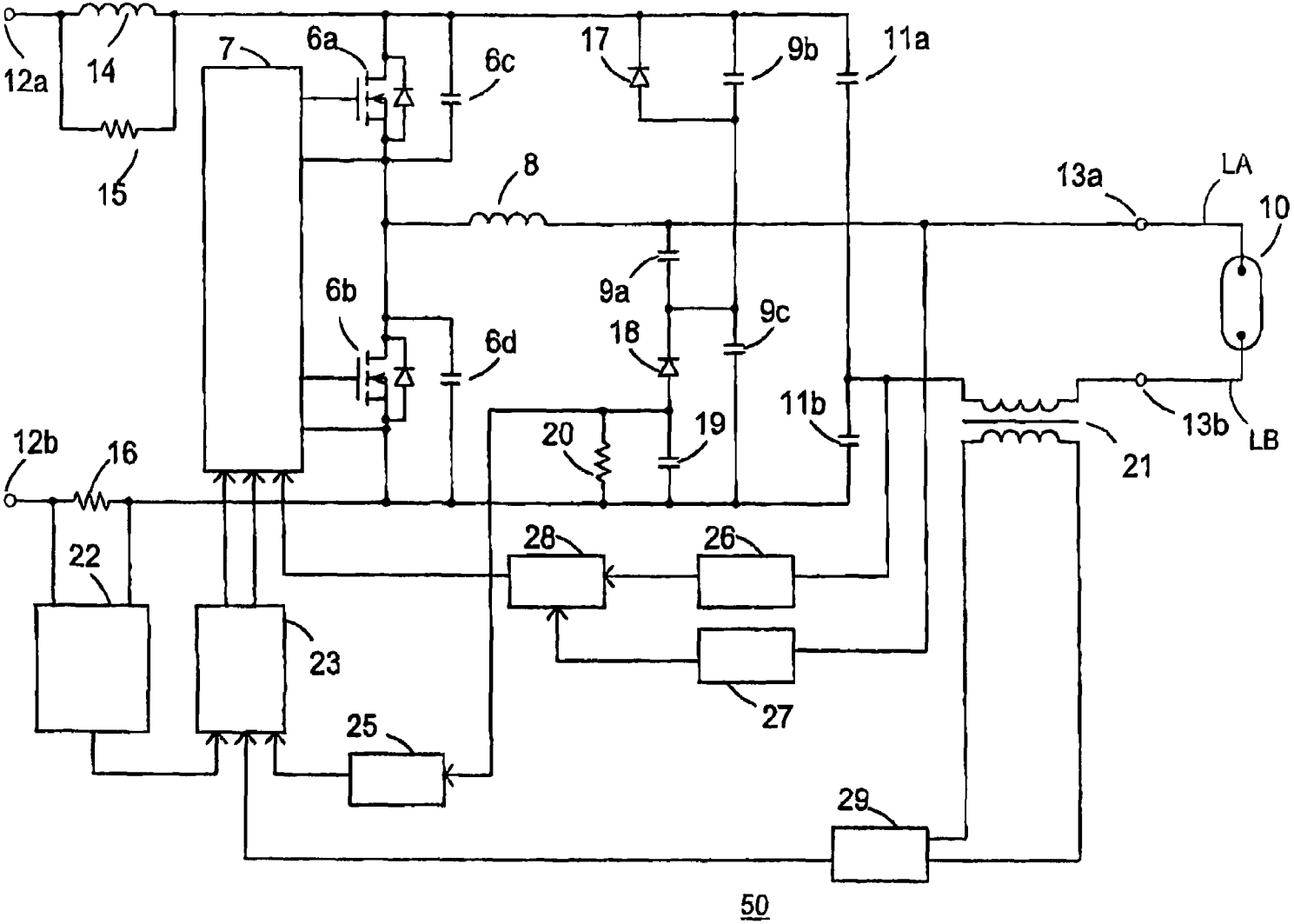
FIG. 3 shows a circuit with which the manner of control of the circuit according to the invention can be realized.

For regulating the lamp output and the lamp start voltage, use is made of frequency regulation. A possible embodiment is shown in FIG. 3.

With the dimensioning customary for the power circuit according to the invention, and due to the properties of the gas discharge lamps which are supplied by the power circuit, an increase of the control frequency leads to a decrease of the lamp output or the lamp current.

When the starting conditions as described hereinafter are met, at the start also, an increase of the control frequency leads to a decrease of the alternating voltage on the lamp output terminal 13*a*.

With the control and dimensioning according to the invention, the resonance frequency of the resonant circuit lies slightly below a whole odd multiple of the control frequency, and the characteristic impedance of the resonant circuit is high in comparison with the power circuits mentioned in the introduction, which, at maximum lamp power, work on approximately the resonance frequency of the lamp coil and output capacity. This means especially that, in normal operation, virtually no current runs through resonance capacity 9 and the current through coil 8 remains lower. Moreover, while maintaining the nominal lamp output, the self-induction value of the coil, given an equal control frequency, can be selected to be lower. In particular, it holds that the power circuit is arranged such that for starting the lamp, the resonance frequency of a resonant circuit of the power circuit, formed by at least the lamp coil and the resonance capacity, divided by the control frequency for bringing the switching elements alternately and not in an overlapping manner into conduction for starting the gas discharge lamp, is somewhat smaller than an odd positive integer, preferably 3%–40% smaller, more preferably 10–25% smaller than the odd positive integer.

As the ignition takes place at a multiple of the control frequency, generating the necessary ignition voltage is possible with a much smaller coil (i.e. fewer windings, a smaller core cross section or both).

In comparison with the power circuit described in U.S. Pat. No. 5,914,571 too, the dimensioning of the lamp coil in the power circuit according to the invention is considerably more favorable, because when operating the lamp at maximum power, the voltage across the lamp coil in the circuit according to the invention is considerably lower than in the series resonant connection between driving ac-voltage and lamp to be supplied according to U.S. Pat. No. 5,914,571. Here, rise of the voltage on the resonance frequency in normal operation causes a relatively high voltage across the lamp coil, while in both cases the coil current is approximately equal to the lamp current. With the lamp coil in the circuit according to U.S. Pat. No. 5,914,571, this leads to a relatively large coil with relatively much loss.

Thus, in practical power circuits, the total losses, in all components together, in particular in the input filter, the rectifier, the Power Factor Corrector, the power transistors and the lamp coil, can be limited to 4 percent of the generated lamp output of, for instance, 400 Watts.

Also, the current in the resonance circuit for obtaining a particular ignition voltage is reduced by a factor of resonance frequency divided by control frequency—hence by a factor of three in the preferred embodiment of the circuit according to the invention—relative to the customary dimensioning and manner of control, while the control frequency of the lamp at maximum power and at ignition are approximately equal, while yet the switching frequency of transistors 6*a* and 6*b* maintains a low value during ignition.

Further, as the conditions of Zero Voltage Transition are met, the load of the power transistors becomes very favorable; no "shoot through" currents occur when switching. In the breaking stage, the switching transistor has already been completely blocked at the moment when there is only a very low voltage across the transistor, for instance 10% of the input dc-voltage, while the power transistors' going into conduction only takes place when the current passes through the antiparallel diode of the transistor. Owing to the low switching frequency and owing to the Zero Voltage Transition being met, the switching losses in the power transistors remain very low in the start phase.

Figure 2:
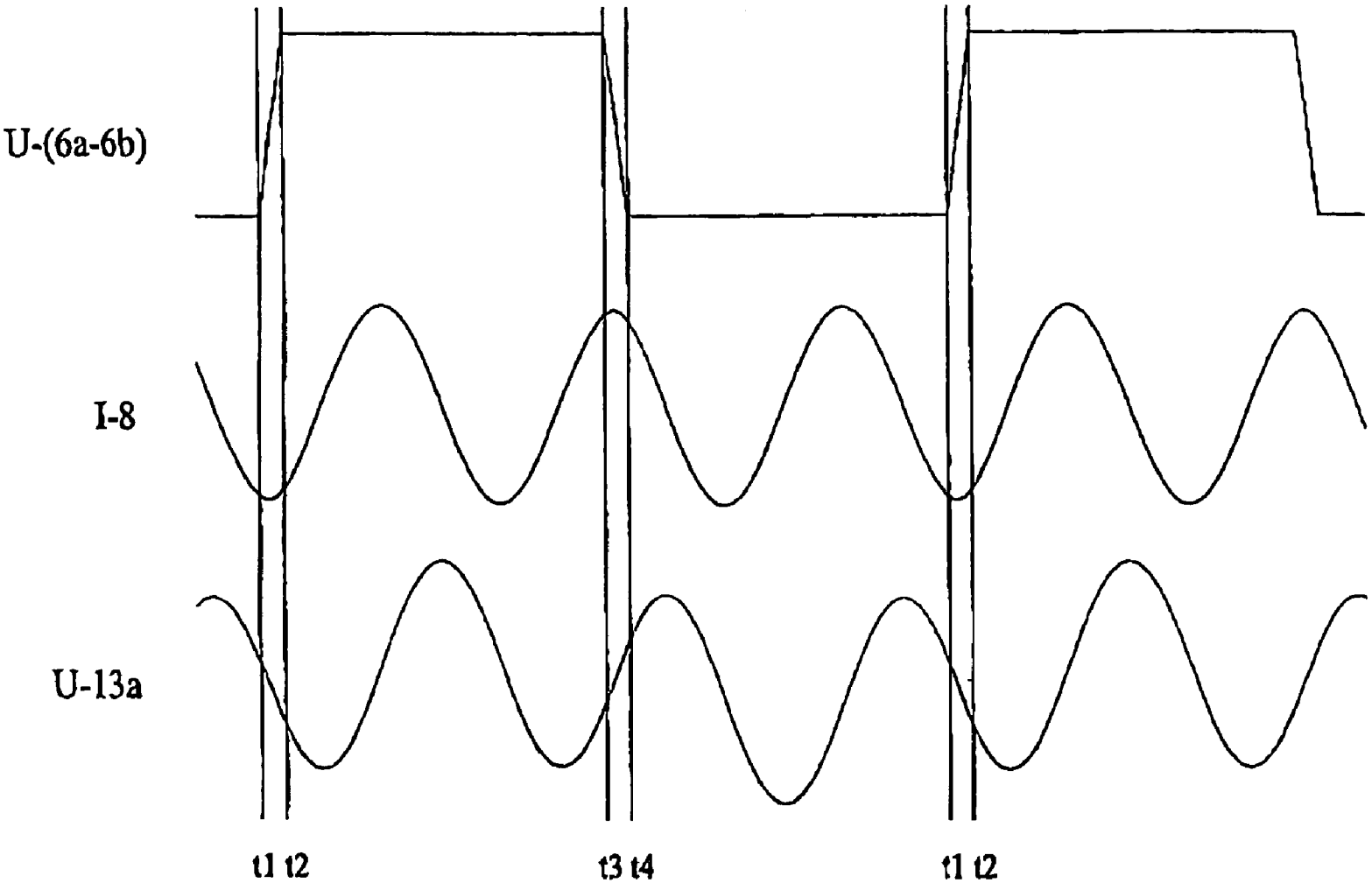
FIG. 2 represents the voltage and current forms which occur when generating the ignition voltage if the circuit of FIG. 1 is controlled according to the invention, and represents, respectively, the voltage on the junction of transistors 6*a* and 6*b*, the current through coil 8 and the voltage between the output terminals 13*a* and 13*b;*

In FIG. 2, voltage and current forms are depicted which occur during unloaded operation, when no lamp is connected, or in the pre-ionization phase of the lamp.

The starting frequency of variable frequency oscillator 23 is set such that the control frequency for alternately bringing the switching elements, such as, for instance, power transistors 6*a* and 6*b*, into conduction is slightly higher than, for instance, one-third or one-fifth of the resonance frequency of the output circuit, formed by lamp coil 8, resonance capacities 9*a*, 9*b* and 9*c* and the wiring capacity, if any, of the connecting line 13*a* to earth and return line 13*b*. At time t1, transistor 6*b* is rendered non-conductive and the current through coil 8 cause capacitors 6*c* and 6*d* to be reverse charged until, at time t2, the antiparallel diode present in the transistor 6*a* goes into conduction.

Then, the control circuit 7 conductively controls the transistor 6*a*. At time t3, transistor 6*a* is rendered non-conductive and the coil current through current 8 again causes the capacitors 6*c* and 6*d* to be reverse charged until, at time t4, the antiparallel diode of transistor 6*b* goes into conduction, whereupon transistor 6*b* is driven conductively again.

The control circuit thereupon gradually tunes down the control frequency, so that the amplitude of the output voltage on lamp terminal and the coil current through coil 8 gradually rise without this involving great phase changes, i.e. the above-described switching sequence remains intact.

In the intervals t1–t2 and t3–t4, the conditions of what is known in the literature as Zero Voltage Transition are met, so that the switching losses in power transistors 6*a* and 6*b* remain low, and the generated electromagnetic interference remains low. The control frequency keeps decreasing until the output voltage on lamp terminal 13*a* has become so high that the control circuit 25, represented in FIG. 3, prevents a further decrease of the control frequency, as will be described in detail hereinafter. Depending on the type of lamp, the condition and history of the lamp and the ambient conditions, the lamp in the starting phase can damp the resonance in the output circuit directly to such an extent that the maximum value of the output voltage is not achieved, and the control circuit 25 does not become active.

Figure 7:
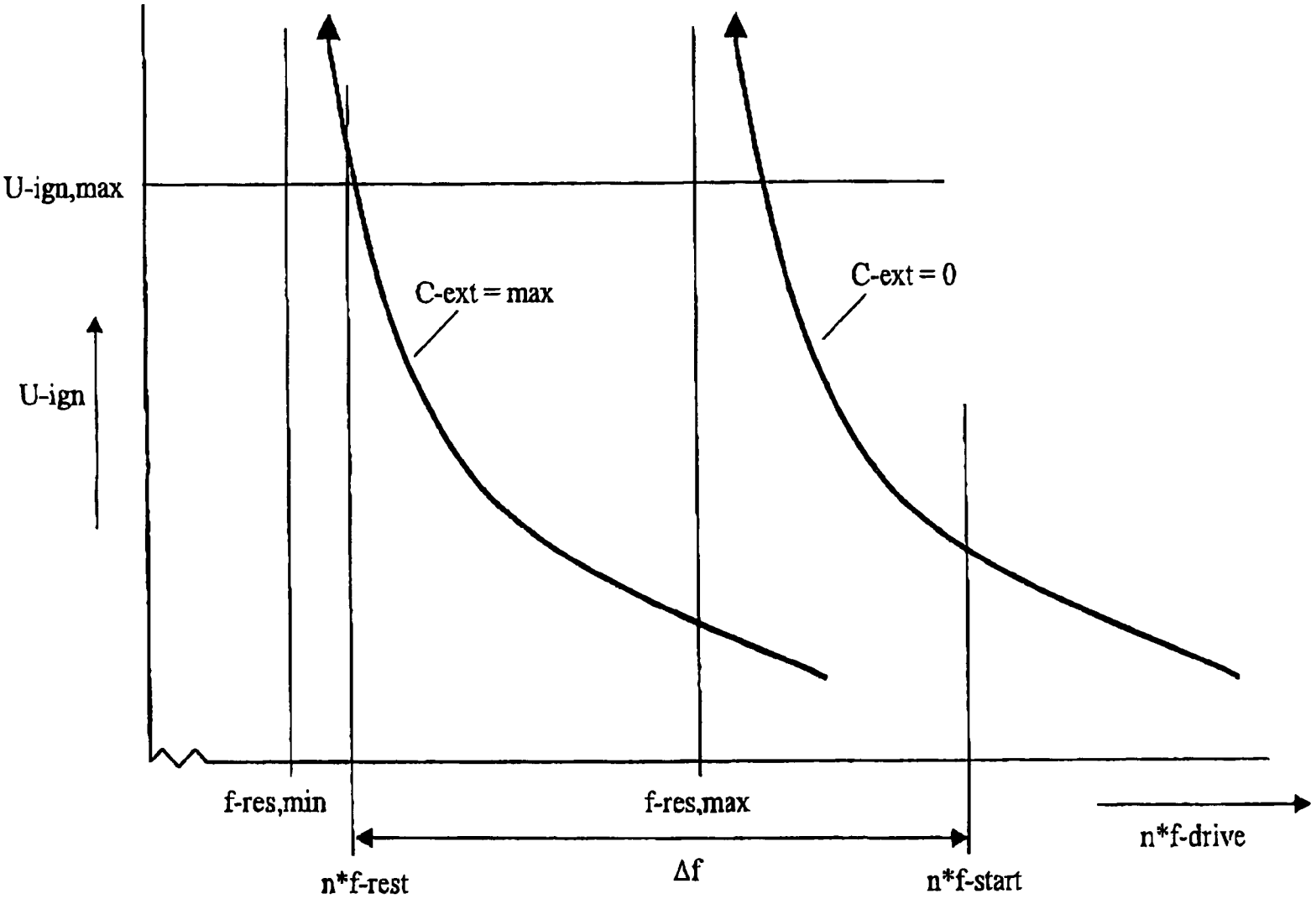
FIG. 7 shows the ignition voltage as a function of the control frequency with and without additional wiring capacity.

The curve of the ignition voltage U-ign on lamp output terminal 13*a* and the influence of an external wiring capacity is represented in FIG. 7. The factor n is an odd integer, in the preferred embodiment of the circuit equal to three. In the preferred embodiment of the circuit according to the invention, the variable frequency oscillator has a particular quiescent setting, corresponding to a control frequency f-rest for the power transistors. When switching on, the control frequency is increased to f-start, after which it gradually decreases again. The ignition voltage U-ign now proceeds as indicated in the characteristics of FIG. 7. Represented are the two extreme situations, no wiring capacity (C-ext=0) and maximum wiring capacity (C-ext=max), for which the power circuit is designed.

As soon as the output voltage reaches the value U-ign, due to the influence of regulation circuit 25, a further decrease of the control frequency is prevented. Thus, it is not only achieved that the ignition voltage has a well defined value, but also that the points indicated with arrows in the characteristic are never attained. These arrows indicate the point where core saturation causes a sudden drop of the self-inductive value of the lamp coil, so that a sudden increase of the resonance frequency f-res occurs. In this point, very high voltages and currents are formed and no Zero Voltage Transition occurs any longer, so that great values of the above-mentioned "shoot through" currents occur, thereby reducing the reliability of the power circuit.

As can be seen in the characteristic of FIG. 7, the frequency n*f-rest lies slightly above f-resmin, at a point such, that with a maximal external wiring capacity, the value U-ign, max of the ignition voltage can still be attained.

A practical embodiment for feeding a 400 Watt metal halide lamp with a maximum cable length of 10 meters between power circuit and lamp, provided in an earthed protective sheath, is dimensioned as follows:

f-resmin=0.9*f-resmax

3*f-rest=1.03*f-resmin f-start=1.15*f-rest.

In particular it holds that in use, the electronic power circuit further comprises a connecting line (La, Lb) of, for instance, at most 10 meters between the lamp output terminals and the gas discharge lamp to be operated, while the wiring capacity of this connecting line is effectively connected in parallel with the resonance capacity mentioned, the resonance frequency mentioned being the resonance frequency of the resonance circuit, formed by the lamp coil and the parallel connection of the resonance capacity and the wiring capacity. Further, it then holds in particular that the electronic power circuit is dimensioned for a predetermined maximum value of the wiring capacity, which results in a particular minimum value (f-resmin) of the resonance frequency mentioned. When no wiring capacity is present, f-resmax is the result, which is determined by the lamp coil and the resonance capacity. Further, it holds in particular that the above-mentioned minimum value of the resonance frequency divided by the rest value deviates less than 8 percent, preferably less than 6 percent and more preferably less than or at most 3 percent from the odd positive integer.

Figure 6:
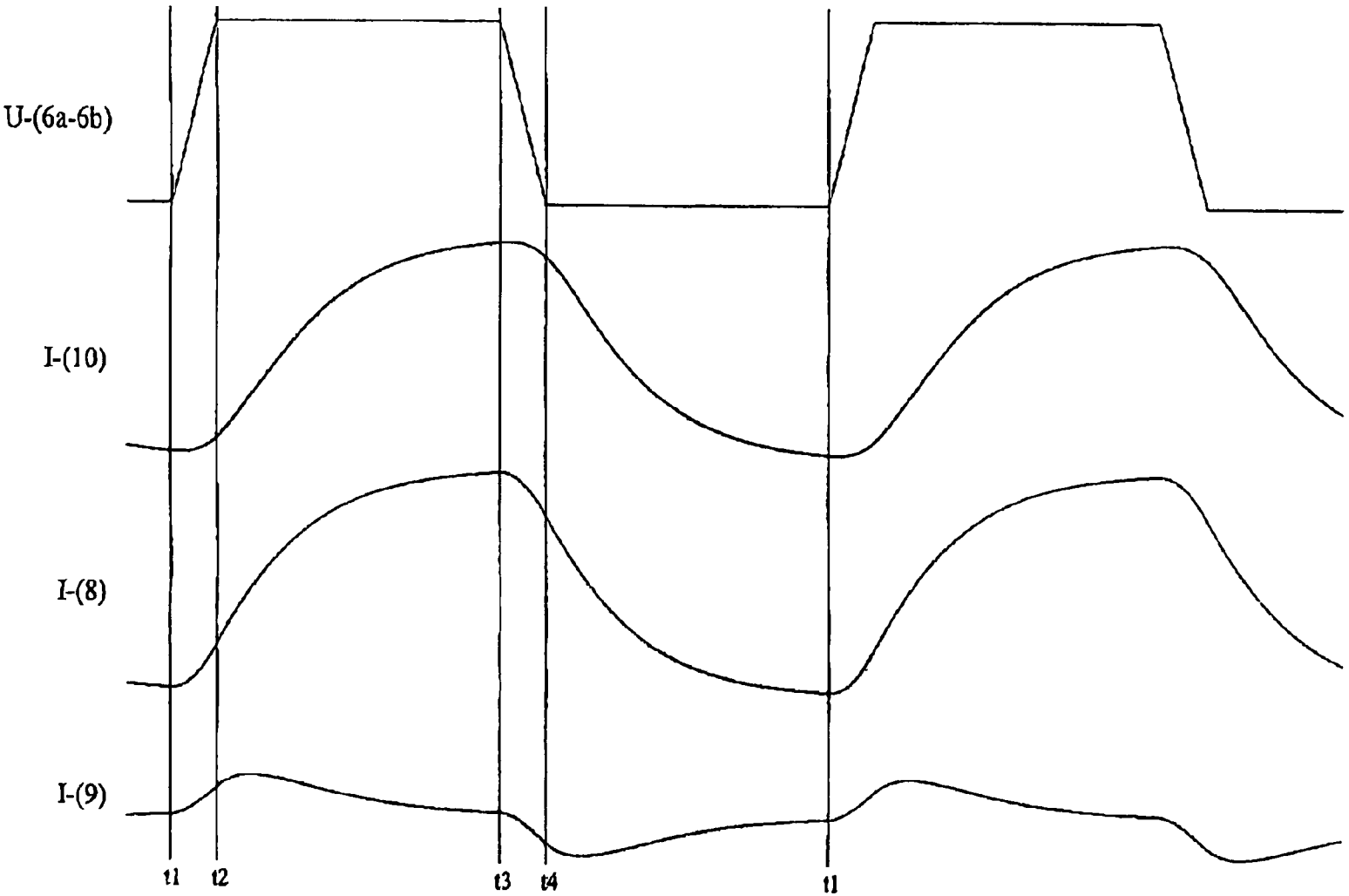
FIG. 6 shows the wave forms occurring in the circuit given normal operation and maximum lamp output.

After ignition of the lamps, the wave forms are as represented in FIG. 6.

At time t1, the transistor 6*b* is blocked and in the interval t1–t2, transistor 6*a* as well as transistor 6*b* block. In this interval, the coil current I(8) reverse charges the capacitors 6*c* and 6*d*. At time t2, the antiparallel diode present in transistor 6*a* goes into conduction, whereupon the control circuit 7 conductively controls the channel of power transistor 6. At time t3, control circuit 7 controls the transistor 6*a* in a blocking manner, during the interval t3–t4, the capacities 6*c* and 6*d* are reverse charged, whereupon, once again, the control circuit 7 conductively controls the channel of transistor 6*b*. In the intervals t1–t2 and t3–t4, the conditions for Zero Voltage Transition are met.

The wave forms in FIG. 6 indicate that the amplitude of the current through capacity C9 is small in relation to the lamp current, so that the effective value of the coil current I(8) in coil 8 is hardly larger than the lamp current I(10) through the gas discharge lamp 10 supplied, so that the losses in the coil 8 remain very small.

In FIG. 3, a possible embodiment of the regulating and control circuits with which the manner of control according to the invention can be realized is represented.

The switching elements 6*a* and 6*b*, such as, for instance, power transistors are switched, via control circuit 7, which delivers control pulses for bringing the power transistors alternately and not in an overlapping manner into conduction, with a variable frequency, which is determined by variable frequency oscillator 23.

Connected in series with dc-voltage terminal 12*b* is a current measuring resistance 16. In the customary arrangement, the dc-voltage on the dc-voltage terminals 12*a* and 12*b* is delivered by the Power Factor Corrector 5 indicated in FIG. 1. This Power Factor Corrector delivers a virtually constant dc-voltage, in that the control amplifier built into the Power Factor Corrector 5 controls the current taken from the ac-voltage supply such that the output voltage is stabilized at a fixed value. In control amplifier 22, the measured current is compared with a desired value. When there are differences between the measured and the desired value of the current from Power Factor Corrector 5 to the connected circuit, the variable frequency oscillator 23 is adjusted such that desired and real value become equal to each other.

As a result, a constant current and, because the output voltage of the Power Factor Corrector is approximately constant, also an approximately constant power is taken up from the Power Factor Corrector 5. As the conversion efficiency of the supplied dc-voltage to ac-voltage delivered to the lamp is very high, for instance between 98% at full power and 96% at reduced power, in this manner, also the lamp output is stabilized. By changing the desired power value P-set in the control amplifier 22, the power furnished to the lamp can be set.

Any small variations in lamp output as a result of developing weak acoustic resonances in a high intensity gas discharge lamp that might occur in spite of the higher control frequency, are, in this manner, suppressed through a rapid power regulation, so that also the acoustic resonances mentioned do not cause any adverse effects.

The value P-set can also be set externally via a signal interface, not shown in FIG. 3, for instance an analogous signal level.

In series with dc-voltage terminals 12*a* and 12*b*, a coil 14 can be included for reducing the ac-voltage load of the electrolytic capacitor included in Power Factor Corrector 5, so that its life span is prolonged, and also for reducing the effective current load of current measuring resistance 16 resulting from the switching of power transistors 6*a* and 6*b*. As a result, also without much filtering, the dc-voltage can be measured by current measuring resistance 16. In that case, however, the series connection of power transistors 6*a* and 6*b* should have its own uncoupling capacity, which serves as an energy buffer to have the ac-voltage, which is formed by the switching of transistors 6*a* and 6*b*, result in an acceptably small ac-voltage across the series connections of these transistors, so that particularly the inverse voltage of these power transistors is not exceeded.

In the exemplary embodiment of FIG. 3, the buffer function, series connection of capacity 11*a* and 11*b*, is combined with the dc-voltage blocking function of coupling capacity 11 in FIG. 1, which, in FIG. 3, is split into capacity 11*a* and 11*b*.

Resistance 15 can be added for damping resonances of coil 14 with coupling capacities 11*a* and 11*b*.

In FIG. 3, resonance capacity 9 from FIG. 1 has been divided into three capacities 9*a*, 9*b* and 9*c*, while 9*b* and 9*c* are parallel connected via the buffer capacitors with a greater capacity value 11*a* and 11*b*. Further, the relation between capacity value of capacity 9*a* and capacity values of capacities 9*b* and 9*c* is such that at the desired ignition voltage, clip diodes 17 and 18 go just into conduction at the peak-and-valley values of the output voltage. Due to the clip diodes 17 and 18 going into conduction for a part of the high frequency switching period, the effective resonance capacity becomes greater, and hence the resonance frequency of the output circuit lower, and the output voltage has less tendency to increase, so that the regulating stability of the output voltage limitation is improved.

Due to the clip diodes 17 and 18 going into conduction periodically, capacitor 19 is slightly negatively charged. Between the intervals in which the clip diode 18 is conductive, capacitor 19 is slightly discharged again by resistance 20. When the absolute value of the voltage on capacitor 19 exceeds a value preset in control amplifier 25, variable frequency oscillator 23 is adjusted such that the output voltage remains virtually constant.

By including a current measuring transformer 21 in series with one of the output voltage terminals 13*a* and 13*b*, the output current can be measured. Via control amplifier 29, variable frequency oscillator 23 is controlled such that the output current is limited at a value acceptable for lamp and circuit. In a different dimensioning, this circuit can be designed such that the circuit is active as a lamp current stabilization circuit. The above-mentioned power limitation circuit 22 and current measuring means 16 can then be omitted.

In normal operation, after ignition of the lamp, there is a dc-voltage on the junction of capacitors 11*a* and 11*b* which is equal to half the input dc-voltage which is presented to input terminals 12*a* and 12*b*. When the lamp starts exhibiting rectifying effects, the dc-voltage on the junction of capacitors 11*a* and 11*b* changes. Depending on the direction in which the rectifying effect in the gas discharge lamp occurs, the voltage on this junction will rise or fall.

As will be further described in detail, in such a situation, the control for power transistors 6*a* and 6*b* is blocked.

When no lamp is connected, or when the lamp fails to start, measuring circuit 27 detects that the output voltage remains high and also, via time interval circuit 28, the gate drive for power transistors 6*a* and 6*b* is interrupted, as will be described later in more detail.

Figure 4:
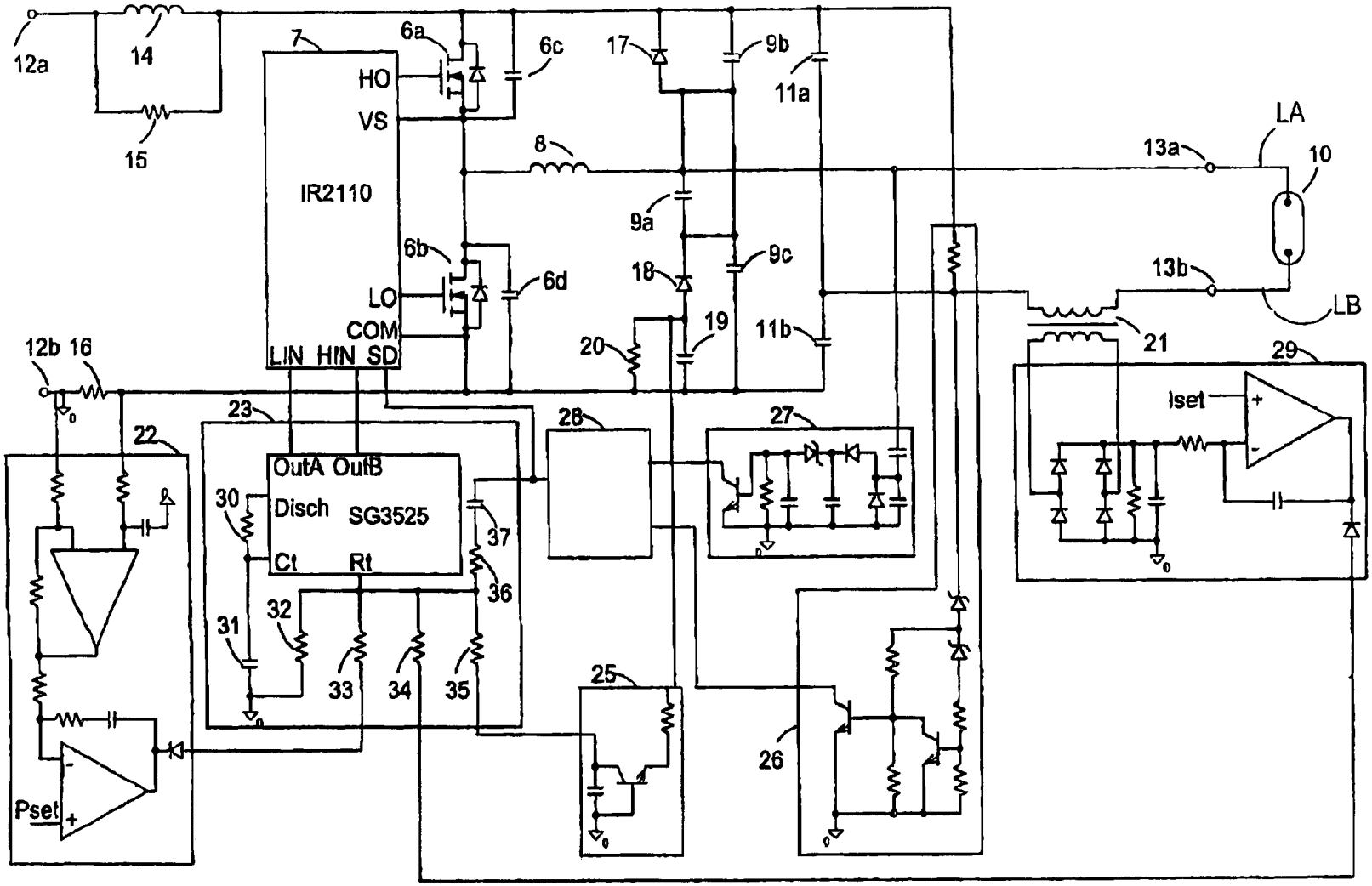
FIG. 4 shows a more detailed elaboration of the circuit of FIG. 3.

In FIG. 4, a more detailed possible elaboration of the circuit to which the invention relates is represented. Here, the function of variable frequency oscillator 23 is performed by an IC, for instance type SG 3525. This oscillator generates two control signals for bringing power transistors 6*a* and 6*b* alternately and not in an overlapping into conduction. By gate drive circuit 7, which may consist of an IC type IR2110, these control signals are brought at the desired level for power transistors 6*a* and 6*b*. The time during which neither of the two power transistors 6*a* and 6*b* are in conduction, the so-called dead time, is determined by capacitor 31 and resistance 30 and delays in IC type SG 3525. Together with capacitor 31, resistance 32 determines the minimum oscillator frequency. In the preferred embodiment of the circuit according to the invention, the oscillator frequency, further indicated as quiescent frequency, in the situation where no current passes through one of the resistances 33, 34 or 35, is set on or just below one-third of the resonance frequency of the output circuit L(8) and C(9).

The oscillator frequency can be increased via resistance 33, which is connected to the output of circuit 22, to reduce the power furnished by the circuit to the lamp, via resistance 34 which is connected to the output of circuit 29 to limit or stabilize the lamp current, and via resistance 35, which is connected to the output of circuit 25, to limit the output voltage in the ignition interval at a particular value. Via resistance 36 and capacitor 37, immediately after the first switch-on and before the lamps are started, the oscillator frequency is set at a higher value, in that circuit 28 renders the signal SD low, so that the control circuit 7 can start delivering control pulses for the alternate and non-overlapping conductive drive of power transistors 6*a* and 6*b*. As a result, the circuit starts in the Zero Voltage Transition mode, as described hereinabove. Due to capacity 37 discharging, the control frequency approximates the quiescent frequency of the oscillator, whereupon, depending on a lamp being present or not, the type of lamp and the lamp condition, one of the circuits 25, 29 or 22 prevents a further decrease of the frequency, or the frequency drops entirely to the quiescent frequency. After ignition of the lamp, depending on the type of lamp and the dimensioning of the circuit, first, circuit 29 can take care of the regulation of the frequency of the oscillator circuit, and immediately or after warming up of the lamp, circuit 22 will take over the frequency control. In embodiments in which the lamp current is stabilized, current measuring resistance 16, circuit 22 and resistance 33 are not included, and circuit 29 effects the control of the oscillator frequency. For an optimal operation with a highest possible efficiency, the dimensioning of the circuit will be chosen such that the circuit, at maximum lamp power, is as close as possible to the minimum frequency, but there should be sufficient reserve to regulate and eliminate in particular variations in lamp properties.

As a rule, for that reason, the control frequency will be close to the minimum frequency, when the lamp is operated at full power. In most cases, with maximal lamp output, the control frequency will not be more than a factor of one and a half above the minimum frequency. In particular, it holds that, when operating the gas discharge lamp at the specified maximum power of the gas discharge lamp, the control frequency mentioned lies between 90% of the control frequency at starting of the lamp and a value which lies a factor of one and a half higher. Via time interval circuit 28, in case of too high a dc-voltage or too high an ac-voltage, respectively, on the output terminals 13*b* and 13*a*, respectively, after a short delay time, safety circuits 26 and 27 can block the control pulses for power transistors 6*a* and 6*b* for a longer period of time, by delivering a Shut Down (SD) signal to control circuit 7. After a (predetermined) waiting time or after removing and re-applying the power voltage, the circuit 28 initiates a new start.

Time interval circuit 28 limits the time interval during which ignition voltage is present, as signalled by circuit 27, or the time interval in which the dc-voltage on the output falls outside of a predetermined window, as signalled by circuit 26, on a value safe for power transistors 6*a* and 6*b*. By means of a high signal SD on the input of control circuit 7, the output of time interval circuit 28 can block the alternate conductive control of power transistors 6*a* and 6*b*.

In a first possible embodiment of the invention, power transistors 6*a* and 6*b* remain blocked after control circuit 7 is blocked by signal SD by time interval circuit 28, until the input voltage of the circuit has been interrupted and after that is presented again.

In a different embodiment, the power transistors 6*a* and 6*b*, some time (preferably a predetermined period of time) after having been switched off by time interval circuit 28, are autonomously switched on again in an on/off time ratio such that the average losses in power transistors 6*a* and 6*b* remain sufficiently low to prevent the power transistors becoming defective.

A counter can be included in the time interval circuit, which ensures that the control circuit after being switched on a (preferably predetermined) number of times, permanently blocks the control circuit until the power voltage is removed. In particular, it holds that, at the moment the control pulses are given for the first time after having been blocked, the oscillator frequency is increased such that the control frequency rises by 5% to 20% relative to the quiescent value and, thereupon, gradually decreases again to the quiescent value. In particular, it further holds that the moment the control pulses are given for the first time after having been blocked, the oscillator frequency (f-start) is increased such that the control frequency increases by 5% to 20%, preferably approximately 8%–18%, more preferably approximately 15% relative to the quiescent value, and thereupon gradually decreases again to the quiescent value unless the frequency control means influences the frequency of the variable frequency oscillator.

Figure 5:
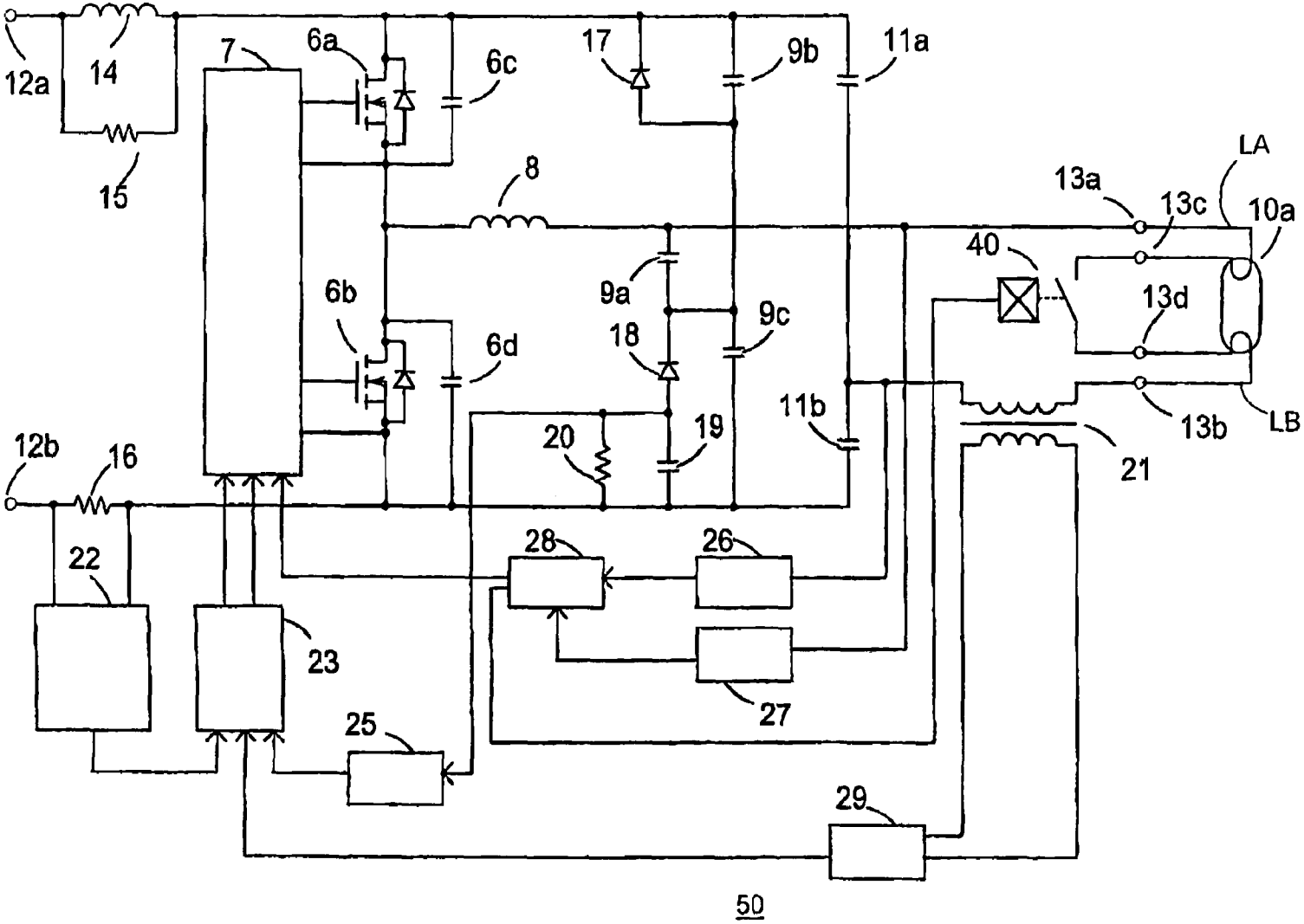
FIG. 5 shows an embodiment of the circuit according to the invention with the possibility of preheating the lamp electrodes.

In FIG. 5, a possible embodiment of the circuit according to the invention is represented for use with a low intensity gas discharge lamp 10*a*, whose electrodes are pre-heated before the ignition voltage is presented. One electrode of the lamp is then connected between output terminals 13*a* and 13*c* and the other electrode between output terminals 13*b* and 13*d*. Before power transistors 6*a* and 6*b* are switched on, the time interval circuit 28 energizes relay 40 so that both electrodes are connected in series between output terminals 13*a* and 13*b*. After power transistors 6*a* and 6*b* have been alternately switched on for some time, they are switched off again by time interval circuit 28, whereupon, after a short period of time, also relay 40 is switched off. After some time, when it is certain that the relay contact is sufficiently opened, power transistors 6*a* and 6*b* are alternately switched on again, so that between output terminals 13*a* and 13*b* the ignition voltage appears, regulated in the same manner as described in the foregoing.

In the foregoing, the starting point was that the power circuit is supplied from an ac-voltage source. There are situations in which a dc-voltage is available, from which the above-described circuit is supplied. This is possible without further adaptations to the rest of the circuit, but in case the lamp output is stabilized, the dc-voltage must have a constant value.

In the Figures, for the power transistors 6*a* and 6*b*, power transistors of the MOSFET-type are used. However, the circuit according to the invention can also be realized with power transistors of the IGBT-type, or of the bipolar junction transistor (BJT)-type, provided that on these power transistors, so-called free-run diodes are provided.

Figure 8:
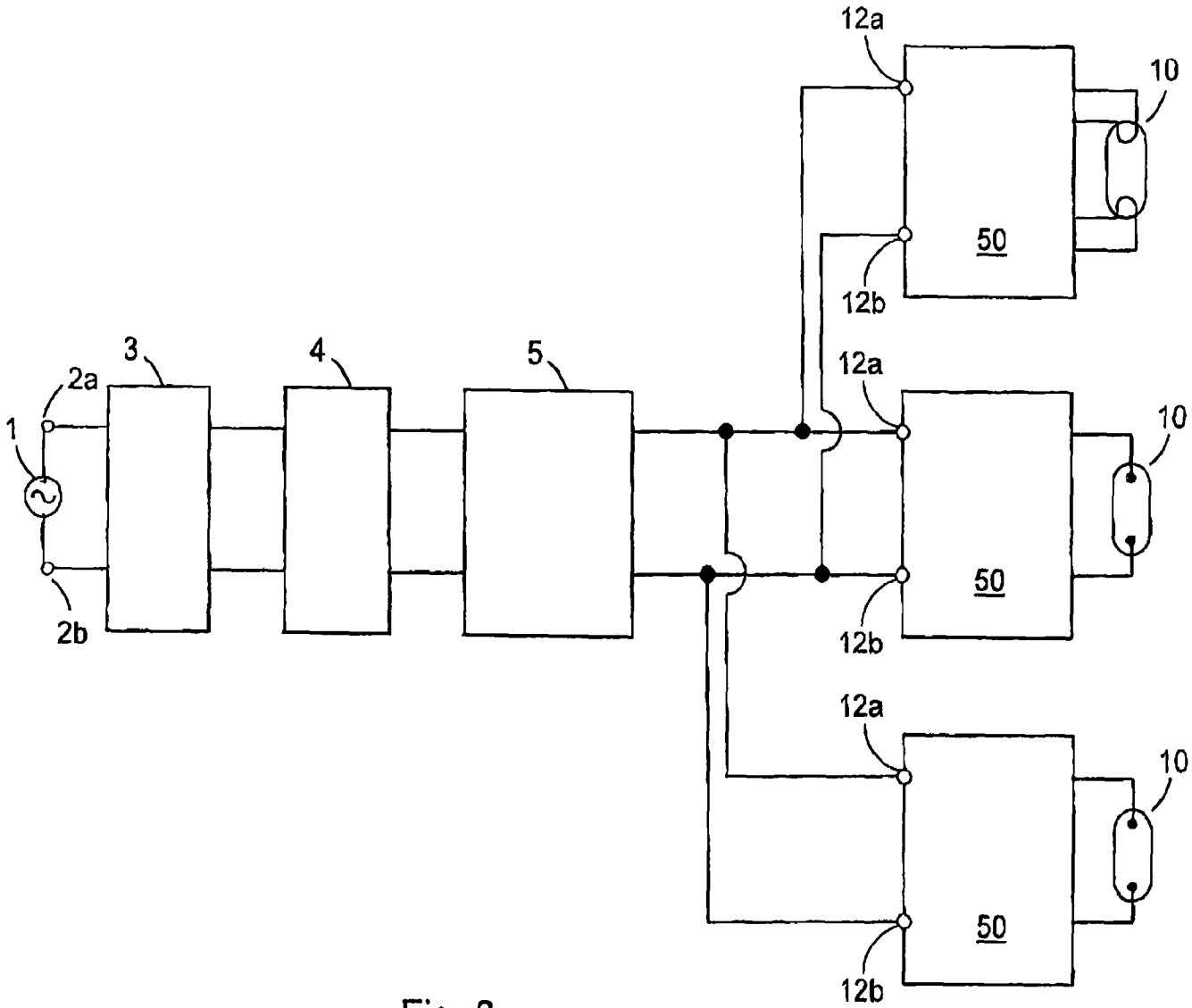
FIG. 8 shows a power circuit system according to the invention for controlling a plurality of gas discharge lamps.

Further, it is possible to realize a power circuit system for feeding several gas discharge lamps, wherein a common Power Factor Corrector having, pre-connected, a filter and rectifier, is followed by the power circuits described hereinabove. FIG. 8 schematically shows an example hereof. The power circuit system for starting and operating a plurality of gas discharge lamps each to be connected to two or four lamp output terminals. The power circuit system is provided with a plurality of power circuits as described hereinabove. Each lamp is connected to one of the power circuits. The system is further provided with input ac-voltage terminals for connecting an ac-voltage source and a rectifier, while the rectifier is included between the input ac-voltage terminals on the one side and each of the respective input dc-voltage terminals of the plurality of power circuits. Preferably, the system is further provided with a Power Factor Corrector and an interference suppressing filter while an input of the Power Factor Corrector is connected via the radio frequency interference suppressing filter and the rectifier to the input ac-voltage terminals while an output of the Power Factor Corrector is connected to each of the respective input dc-voltage terminals of the plurality of power circuits.

The invention is not limited in any manner to the embodiments outlined hereinabove. For instance, the output detection circuits and the time interval circuits can be included in one and the same circuit and, for instance, be accommodated in a chip. This also holds for the variable oscillator, the control circuit 7 and the like.

The invention claimed is:

1. A power circuit for starting and operating a gas discharge lamp with ac-voltage, wherein the power circuit is provided with:

at least a first and a second lamp output terminal between which, in use, the gas discharge lamp is connected, a dc-voltage input, with at least two input terminals, a series connection of at least two switching elements such as, for instance, power transistors, which is connected between the input terminals of the dc-voltage input, a control circuit arranged for delivering control pulses to the switching elements for alternately and not in an overlapping manner bringing said switching elements into conduction, at least one lamp coil which is connected, on the one side, to the junction of said switching elements and which, on the other side, is connected with the first lamp output terminal, at least one resonance capacity, at least comprising one or more capacitors while the resonance capacity is connected, on one side, to the first lamp output terminal and, on the other side, is connected to one or both input terminals, at least one coupling capacity, at least comprising one or more capacitors, the coupling capacity having a capacity value which is considerably greater than the capacity value of the resonance capacity, the coupling capacity being connected on the one side with the second lamp output terminal and being connected on the other side with one or both terminals of said dc-voltage input and a variable frequency oscillator which, in use, delivers a signal to said control circuit with a frequency which is determinative of the control frequency with which said switching elements are brought into conduction periodically and not in an overlapping manner, characterized in that the power circuit is arranged such that for starting the lamp, the resonance frequency of the resonance circuit of the power circuit, formed by at least the lamp coil and the resonance capacity, divided by the frequency of the control pulses for alternately and not in an overlapping manner bringing said switching elements into conduction for starting the gas discharge lamp, is slightly smaller than an odd positive integer, preferably 3%–40% smaller, more preferably 10% to 25% smaller than the odd positive integer.

2. The power circuit according to claim 1, characterized in that, in use, the power circuit further comprises a connecting line (La, Lb) of, for instance, at most 10 meters between the lamp output terminals and the gas discharge lamp to be operated, wherein the wiring capacity of this connecting line is connected effectively in parallel with said resonance capacity, while said resonance frequency is the resonance frequency of the resonance circuit, formed by the lamp coil and the parallel circuit of the resonance capacity and the wiring capacity.

3. The power circuit according to claim 2, characterized in that the power circuit is dimensioned for a predetermined maximum value of the wiring capacity, which results in a particular minimum value (f-resmin) of said resonance frequency.

4. The power circuit according to claim 1, characterized in that said odd positive integer is equal to three.

5. The power circuit according to claim 1, characterized in that said odd positive integer is equal to five.

6. The power circuit according to claim 1, characterized in that said control frequency, while operating the gas discharge lamp at the specified maximum power of the gas discharge lamp, lies between 90% of the control frequency when starting the lamp and a value which is higher by a factor of one and a half.

7. The power circuit according to claim 1, characterized in that the circuit is further provided with frequency control means for influencing the frequency of the variable oscillator.

8. The power circuit according to claim 7, characterized in that the frequency control means are provided with a first output voltage detection circuit arranged for effecting, when the output ac-voltage on said first lamp output terminal exceeds a particular value, that the frequency of said variable frequency oscillator is influenced such that a first predetermined maximum output voltage value of the output voltage on the first lamp output terminal is not exceeded.

9. The power circuit according to claim 8, characterized in that the resonance capacity is provided with a first partial resonance capacity and a second partial resonance capacity, the first partial resonance capacity comprising at least one capacitor, while a first side of the first partial resonance capacity is connected to the first lamp output and a second side of the first partial resonance capacity is connected to the anode of a first clip diode, to the cathode of a second clip diode and to a first side of the second partial resonance capacity, the second partial resonance capacity being provided with at least one capacitor and wherein a second side of the second partial resonance capacity is connected to one or both terminals of the input dc-voltage, while the cathode of the first clip diode is connected to the positive input terminal of the input dc-voltage, and the anode of the second clip diode is connected to the first output voltage detection circuit.

10. The power circuit according to claim 1, characterized in that the power circuit is provided with a time interval circuit which is connected to the control circuit and a second output voltage detection circuit one input of which being connected to the first lamp output terminal and one output of which being connected to the time interval circuit, the time interval circuit being arranged for blocking and releasing again, in use, the delivery of control pulses by the control circuit for alternately and not in an overlapping manner bringing the power transistors into conduction, while the second output voltage detection circuit is arranged for ensuring that the time interval circuit will block the delivery of control pulses if the output ac-voltage on the first lamp output terminal exceeds a predetermined second maximum output voltage value.

11. The power circuit according to claim 10, characterized in that the time interval circuit is arranged for continuing to block, after the blocking of the delivery of control pulses has started, the delivery of control pulses when the output ac-voltage on the first lamp output terminal exceeds the second maximum output voltage value for a predetermined period of time.

12. The power circuit according to claim 1, characterized in that a second output voltage detection circuit is included, connected to the first lamp output terminal; the output of which is connected to a time interval circuit, while the time interval circuit blocks the delivery of control pulses for alternately and not in an overlapping manner bringing the power transistors into conduction when the output ac-voltage on the first lamp output terminal, for a particular period of time, exceeds a second maximum output voltage value, while this blocking is maintained.

13. The power circuit according to claim 8, characterized in that the second maximum voltage value is lower than the first maximum voltage value.

14. The power circuit according to claim 8, characterized in that the second maximum voltage value is lower than the first maximum voltage value.

15. The power circuit according to claim 10, characterized in that, after a predetermined time after the blocking of the control pulses has started, the time interval circuit no longer blocks the delivery of control pulses, i.e. releases it again, while the resonance frequency of the resonance circuit of the power circuit, formed by at least the lamp coil and the resonance capacity, divided by the frequency of the control pulses for alternately and not in an overlapping manner bringing said switching elements into conduction for starting the gas discharge lamp, is slightly smaller than an odd positive integer, preferably 3%–40% smaller, more preferably 10% to 25% smaller than the odd positive integer.

16. The power circuit according to claim 15, characterized in that the time interval circuit, after it has blocked and released again the delivery of the control pulses for a predetermined number of times, permanently blocks the delivery of the control pulses.

17. The power circuit according to claim 1, characterized in that the power circuit is provided with a third output voltage detection circuit and a time interval circuit connected to the control circuit while the third output voltage detection circuit is connected to the second lamp output terminal and is arranged for ensuring that the time interval circuit will block the delivery of control pulses when the output dc-voltage on the second lamp output terminal lies beyond a particular dc-voltage range for a predetermined period of time.

18. The power circuit according to claim 1, characterized in that a third output voltage detection circuit is included, connected to the second lamp output terminal, which delivers a signal to a time interval circuit, while the time interval circuit blocks the delivery of control pulses for alternately and not in an overlapping manner bringing the power transistors into conduction when the output dc-voltage on the second lamp output terminal lies beyond a particular dc-voltage range for a particular period of time.

19. The power circuit according to claim 17, characterized in that the time interval circuit, some time after the blocking of the delivery of control pulses has started, releases the delivery of these control pulses again, while the resonance frequency of the resonance circuit of the power circuit, formed by at least the lamp coil and the resonance capacity, divided by the frequency of the control pulses for alternately and not in an overlapping manner bringing said switching elements into conduction for starting the gas discharge lamp, is slightly smaller than an odd positive integer, preferably 3%–40% smaller, more preferably 10% to 25% smaller than the odd positive integer.

20. The power circuit according to claim 19, characterized in that the time interval circuit, after this has blocked and released again the delivery of the control pulses a predetermined number of times, blocks the delivery of the control pulses permanently.

21. The power circuit according to claim 1, characterized in that parallel to one or both switching elements voltage rate limiting capacities are included.

22. The power circuit according to claim 7, characterized in that frequency control means are provided with an input current stabilizing circuit and, included in series between one of the input dc-voltage terminals and the rest of the circuit, a current measuring resistance which is connected to the input current stabilizing circuit, while the input current stabilizing circuit is arranged for adjusting the frequency of the variable frequency oscillator such that the input current is stabilized at a predetermined constant input current value.

23. The power circuit according to claim 22, characterized in that the circuit is arranged for setting the predetermined input current value.

24. The power circuit according to claim 8, characterized in that the frequency control means are provided with lamp current measuring means for measuring the lamp current which, in use, is delivered to the connected gas discharge lamp and an output current limiting circuit which is arranged, while controlling the lamp current measuring means, for influencing the frequency of the variable frequency oscillator such that a predetermined particular value of the lamp current is not exceeded.

25. The power circuit according to claim 8, characterized in that the frequency control means are provided with lamp current measuring means for measuring the lamp current which, in use, is delivered to the connected gas discharge lamp and an output current stabilization which is arranged, while controlling the lamp current measuring means, for influencing the frequency of the variable frequency oscillator such that the lamp current through the gas discharge lamp is stabilized at a predetermined value.

26. The power circuit according to claim 25, characterized in that the circuit is arranged for setting the predetermined value at which the lamp current is stabilized.

27. The power circuit according to claim 7, characterized in that the variable frequency oscillator, in a condition in which the frequency control means do not influence the frequency of the frequency oscillator, delivers a frequency which is equal to a predetermined quiescent value (f rest).

28. The power circuit according to claim 3, characterized in that the minimum value of the resonance frequency, divided by the quiescent value deviates less than 8 percent, preferably less than 6 percent and more preferably less than or at most 3 percent from the odd positive integer.

29. The power circuit according to claim 10, characterized in that, at the moment the control pulses are delivered for the first time after having been blocked, the oscillator frequency is increased such that the control frequency increases by 5% to 20% relative to the quiescent value and, thereupon, gradually decreases again to the quiescent value.

30. The power circuit according to claim 29, characterized in that, at the moment the control pulses are delivered for the first time after having been blocked, the oscillator frequency (f-start) is increased such that the control frequency increases by 5% to 20%, preferably approximately 8%–18%, more preferably approximately 15% relative to the quiescent value and, thereupon, gradually decreases again to the quiescent value unless the frequency control means influences the frequency of the variable frequency oscillator.

31. The power circuit according to claim 1, characterized in that between at least one of the input dc-voltage terminals and the rest of the circuit, at least one inductance coil is included.

32. The power circuit according to claim 31, characterized in that parallel to the at least one inductance coil, a damping resistance is included.

33. The power circuit according to claim 1, characterized in that the circuit is arranged for starting and operating a gas discharge lamp with two preheatable electrodes each having two terminals, the circuit further being provided with a relay, a time interval circuit for starting the lamps and a third and a fourth lamp output terminal, while, in use, one of the lamp electrodes is connected between the first and the third lamp output terminal, the other lamp electrode of the gas discharge lamp is connected between the second and the fourth lamp output terminal and the third and the fourth lamp output terminal, respectively, are connected to contacts of the relay, the circuit being arranged such that the relay, while controlling the time interval circuit for starting the lamps is first closed for a predetermined period of time, so that the contacts of the relay are interconnected, during which time also the control circuit delivers control pulses for alternately and not in an overlapping manner bringing the switching elements into conduction, and wherein the relay, after the predetermined period of time, is opened again while controlling the time interval circuit.

34. The power circuit according to claim 33, characterized in that, in use, a predetermined first period of time before opening the relay contact, the time interval circuit blocks the control pulses for alternately and not in an overlapping manner bringing the switching elements into conduction, and re-admits the control pulses a predetermined second period after opening the relay contact.

35. The power circuit according to claim 1, characterized in that in the power circuit further, input ac-voltage terminals are provided for connecting an ac-voltage source, a Power Factor Corrector, an interference suppressing filter and a rectifier, wherein an input of the Power Factor Corrector, via the radio frequent interference suppressing filter and the rectifier, is connected to the input ac-voltage terminals and wherein an output of the Power Factor Corrected is connected to the input dc-voltage terminals.

36. A power circuit system for starting and operating a plurality of gas discharge lamps, each to be connected to two or four lamp output terminals, characterized in that the power circuit system is provided with a plurality of power circuits according to claim 1 wherein each lamp is connected to one of the power circuits, the system further being provided with input ac-voltage terminals for connection of an ac-voltage source and a rectifier, the rectifier being included between, on the one side, the input ac-voltage terminals and each of the respective input dc-voltage terminals of the plurality of the power circuits and wherein, preferably, the system is further provided with a Power Factor Corrector and an interference suppressing filter while one input of the Power Factor Corrector, via the radio frequent interference suppressing filter and the rectifier is connected to the input ac-voltage terminals and wherein an output of the Power Factor Corrector is connected to each of the respective input dc-voltage terminals of the plurality of power circuits.

37. A power circuit for starting and operating a gas discharge lamp with ac-voltage, to be connected between a first and a second lamp output terminal of the power circuit, the power circuit consisting of:

a dc-voltage input with two input terminals, a series circuit of two power transistors, connected between the input terminals of this dc-voltage input, a control circuit delivering control pulses to the said power transistors for alternately and not in an overlapping manner bringing said power transistors into conduction, a lamp coil, connected, on the one side, to the junction of said power transistors, and, on the other side, to the first lamp output terminal, a resonance capacity at least consisting of one or more capacitors, connected, on the one side, to the first lamp output terminal, and, on the other side, to one or both said input terminals, a coupling capacity, consisting of one or more capacitors, with a capacity value which is considerably greater than that of said resonance capacity, and connected to the second lamp output terminal one the one side and to one or both terminals of said dc-voltage input on the other side, a variable frequency oscillator delivering a frequency to the said control circuit which is determinative of the control frequency with which said power transistors are brought into conduction periodically and not in an overlapping manner, characterized in that for starting the lamp, the ratio between the resonance frequency of the resonance circuit, formed by said lamp coil and said resonance capacity and the control frequency for alternately and not in an overlapping manner bringing said power transistors into conduction for starting the gas discharge lamp, is slightly smaller than an odd positive integer.

38. The power circuit according to claim 37, characterized in that the connecting line between the power circuit and the gas discharge lamp to be operated has a relatively great length, while the wiring capacity of this connecting line is connected effectively in parallel with said resonance capacity, and the resonance frequency mentioned in claim 1 is the resonance frequency of the resonance circuit formed by the lamp coil and the parallel circuit of the resonance capacity and the wiring capacity.

39. The power circuit according to claim 38, characterized in that the power circuit is dimensioned for a particular maximum value of the wiring capacity, to which belongs a particular minimum value of said resonance frequency.

40. The power circuit according to claim 37, characterized in that said odd positive integer is equal to three.

41. The power circuit according to claim 37, characterized in that said odd positive integer is equal to five.

42. The power circuit according to claim 1, characterized in that, with the gas discharge lamp in operation at the specified maximum power of the gas discharge lamp, said control frequency lies between 90% of the control frequency at starting of the lamp and a value which lies a factor of one and a half higher.

43. The power circuit according to claim 1, characterized in that a first output voltage detection circuit is included which, when a particular value of the output ac-voltage on said first lamp output terminal is exceeded, delivers a signal with which the frequency of said variable frequency oscillator is influenced such that a first maximum output voltage value of the output voltage on the first lamp output terminal is not exceeded.

44. The power circuit according to claim 43, characterized in that the resonance capacity consists of a first partial resonance capacity, consisting of one or more capacitors, connected, on the one side, to the first lamp output and, on the other side, to the anode of first clip diode, to the cathode of a second clip diode, and to a second partial resonance capacity, consisting of one or more capacitors, the other terminal of which is connected to one or both terminals of the input ac-voltage, while the cathode of the first clip diode is connected to the positive input terminal of the input dc-voltage, and the anode of the second clip diode is connected to said first output voltage detection circuit.

45. The power circuit according to claim 1, characterized in that a second output voltage detection circuit is included, connected to the first lamp output terminal; the output of which is connected to a time interval circuit, the time interval circuit blocking the delivery of control pulses for bringing, alternately and not in an overlapping manner, the power transistors into conduction, if the output ac-voltage on the first lamp output terminal exceeds a second maximum output voltage value for a particular period of time, while this blocking is maintained.

46. The power circuit according to claim 43, characterized in that the second maximum voltage value is lower than the first maximum voltage value.

47. The power circuit according to claim 45, characterized in that, some time after blocking the control pulses, the time interval circuit allows these control pulses to pass again, while the resonance frequency of the resonance circuit of the power circuit, formed by at least the lamp coil and the resonance capacity, divided by the frequency of the control pulses for alternately and not in an overlapping manner bringing said switching elements into conduction for starting the gas discharge lamp, is slightly smaller than an odd positive integer, preferably 3%–40% smaller, more preferably 10% to 25% smaller than the odd positive integer.

48. The power circuit according to claim 47, characterized in that the time interval circuit, when it has blocked and passed the control pulses a particular number of times, blocks the control pulses permanently.

49. The power circuit according to claim 1, characterized in that a third output voltage detection circuit is included, connected to the second lamp output terminal, which delivers a signal to a time interval circuit, while the time interval circuit blocks the delivery of control pulses for bringing the power transistors alternately and not in an overlapping manner into conduction, if the output dc-voltage on the second lamp output terminal lies outside a particular dc-voltage range for a particular time.

50. The power circuit according to claim 49, characterized in that the time interval circuit, some time after blocking the control pulses, allows these control pulses to pass again, while the resonance frequency of the resonance circuit of the power circuit, formed by at least the lamp coil and the resonance capacity, divided by the frequency of the control pulses for alternately and not in an overlapping manner bringing said switching elements into conduction for starting the gas discharge lamp, is slightly smaller than an odd positive integer, preferably 3%–40% smaller, more preferably 10% to 25% smaller than the odd positive integer.

51. The power circuit according to claim 50, characterized in that the time interval circuit, when for a particular number of times, it has blocked and passed the control pulses again, blocks the control pulses permanently.

52. The power circuit according to claim 1, characterized in that parallel to one or both power transistors, voltage rate limiting capacities are included.

53. The power circuit according to claim 1, characterized in that, in series between one of the input dc-voltage terminals and the rest of the circuit, a voltage measuring resistance is included, connected to an input current stabilization circuit, which adjusts the frequency of the variable frequency oscillator such that the input current is stabilized at a constant input current value.

54. The power circuit according to claim 53, characterized in that said input voltage value is adjustable.

55. The power circuit according to claim 1, characterized in that lamp current measuring means are provided, which determine the current delivered to the connected gas discharge lamp, connected to an output current limiting circuit, which influence the frequency of the variable frequency oscillator such that a particular value of the lamp current is not exceeded.

56. The power circuit according to claim 37, characterized in that lamp current measuring means are provided which determine the current delivered to the connected gas discharge lamp, connected to an output current stabilizing circuit, which influence the frequency of the variable frequency oscillator, such that the lamp current through the gas discharge lamp is stabilized at a particular value.

57. The power circuit according to claim 55, characterized in that the value at which the lamp current is stabilized, is adjustable.

58. The power circuit according to claim 1, characterized in that the variable frequency oscillator, in the condition where none of the circuits mentioned in the preceding claims which can influence the frequency of this oscillator is active, is set at a quiescent value, while the ratio between the minimum value of the resonance frequency and the control frequency determined by the variable frequency oscillator, working on the quiescent value, deviates less than 3 percent from an odd positive integer, and that the oscillator frequency, at the moment when the control pulses are delivered for the first time after having been blocked, is increased such that the control frequency rises by 5 to 20% and then decreases gradually again to the quiescent value, unless one of the circuits mentioned in preceding claims influences the frequency of the variable frequency oscillator.

59. The power circuit according to claim 1, characterized in that between at least one of the input dc-voltage terminals and the rest of the circuit at least one inductance coil is included.

60. The power circuit according to claim 59, characterized in that parallel to the at least one inductance coil, a damping resistance is included.

61. The power circuit according to claim 1 for starting and operating a gas discharge lamp with two pre-heatable electrodes each having two terminals, characterized in that the power circuit is provided with a third and a fourth lamp output terminal, wherein one of the lamp electrodes is connected between the first and the third lamp output terminal and the other lamp electrode of the gas discharge lamp between the second and the fourth lamp output terminal, while the third and the fourth lamp output terminal are connected to a contact of a relay, and the relay contact, under the influence of a control signal from a time interval circuit for starting the lamps, is first closed for some time, during which time, further, the control circuit delivers control pulses for alternately and not in an overlapping manner bringing the power transistors into conduction, whereupon the contact is opened.

62. The power circuit according to claim 26, characterized in that, some time before the opening of the relay contact, the time interval circuit blocks the control pulses for alternately and not in an overlapping manner bringing the power transistors into conduction, and some time after opening the opening of the relay contact, readmits the control pulses.

63. The power circuit according to claim 1, characterized in that in the power circuit a Power Factor Corrector is included, the input of which is connected, via a radio frequency interference filter and a rectifier, to the input ac-voltage source, while the output of the Power Factor Corrector is connected to said input dc-voltage terminals.

64. The power circuit for starting and operating several gas discharge lamps, each to be connected to two or four lamp output terminals, characterized in that the power circuit is built up from partial circuits, which partial circuits are designed as described in claim 1, and wherein, for each lamp, one partial circuit is used, while in the power circuit a Power Factor Corrector is included whose input is connected, via a radio frequency interference suppressing filter and a rectifier, to the input ac-voltage source, while the output of the Power Factor Corrector is connected to the input dc-voltage terminals of said partial circuits.

* * * * *